US005283912A

United States Patent [19]

Chung

[11] Patent Number: 5,283,912

[45] Date of Patent: Feb. 8, 1994

[54] MEN'S UNDERPANTS

[75] Inventor: Seun-Yung Chung, Kwangmyung, Rep. of Korea

[73] Assignee: Shin Jeong Yil, Seoul, Rep. of Korea; a part interest

[21] Appl. No.: 867,095

[22] PCT Filed: Apr. 8, 1992

[86] PCT No.: PCT/KR91/00011

§ 371 Date: Jun. 25, 1992

§ 102(e) Date: Jun. 25, 1992

[87] PCT Pub. No.: WO92/18021

PCT Pub. Date: Oct. 29, 1992

[30] Foreign Application Priority Data

Apr. 11, 1991 [KR] Rep. of Korea ..... 91-4939
Apr. 11, 1991 [KR] Rep. of Korea ..... 91-4940

[51] Int. Cl.[5] ..... A41B 9/02

[52] U.S. Cl. ..... 2/403; 2/400; 2/405; 602/68; 602/70; 602/73

[58] Field of Search ..... 2/400, 403, 405; 602/67, 68, 69, 70, 71, 73

[56] References Cited

U.S. PATENT DOCUMENTS

| | | | |
|---|---|---|---|
| 898,258 | 9/1908 | Peters | 2/403 |
| 1,992,351 | 2/1935 | Burnell | 2/403 |
| 4,345,337 | 8/1982 | Chung | 2/405 |
| 4,377,008 | 3/1983 | Jung | 2/403 |
| 4,660,551 | 4/1987 | Nishimura | 2/405 |
| 5,029,345 | 7/1991 | Angheluta et al. | 2/403 |

*Primary Examiner*—Clifford D. Crowder
*Assistant Examiner*—Gloria Hale
*Attorney, Agent, or Firm*—Notaro & Michalos

[57] ABSTRACT

Briefs for the support of male genitalia comprise an inner pants having a hole at a front side of the inner pants such that the genitalia can be inserted through the hole. A front side band having two ends is attached to the front side of the inner pants. A cover is attached to the front side band at one end of the cover and attached to the front side band at an opposite end of the cover for exposing the genitalia. An adjustable loop is attached to the front side of the inner pants and located between the front side of the inner pants and the cover for receiving the penis.

6 Claims, 2 Drawing Sheets

MEN'S UNDERPANTS

FIELD AND BACKGROUND OF THE INVENTION

The present invention relates to a modification of men's underpants. Known briefs are disclosed by Korea Industrial Property Office, Utility Model Numbers 19135 and 19921, and U.S. Pat. No. 4,345,337.

The known briefs for men provided for the promotion of men's hygiene and health by separating the testicles and the penis from the male's body. However, these devices make the wearers feel some discomfort caused by the stitching line of the cloth that rubs against the penis such as a rubbing cloth. Therefore, in response to this problem, a sports panty combined with the underpants and sports pants was developed in an effort to hide the stitching line of the rubbing cloth. However, this sports panty proved to be inadequate for men's underpants even though it did not have any problem when used as a sports panty. This was due to the inconvenience involved when the user sought to expose his genitalia or relieve himself which proved to be a common defect related to this panty.

SUMMARY OF THE INVENTION

The present invention modifies the previous underpants devices by providing a means for the user to expose his genitalia or to relieve himself through the use of a removable cover which is attached to an elastic band located at the top of the underpants. The present invention also provides an adjustable band loop which is installed for the purpose of separating the penis from the testicles which is different from the known devices which use magnetic metal or snap buttons for the adjustment of the band loop size. The present invention employs a long band for free adjustment of a band loop through the use of a fixing knot.

DESCRIPTION OF THE PREFERRED EMBODIMENTS

Known underpants provide a hole in inner pants formed at a front side. A band is positioned on an upper part of the hole and a cover with a rubbing cloth is provided in front of the hole and the band. These known devices make it impossible to separate the cover from the upper part of the front side of the inner pants.

Figure 1:
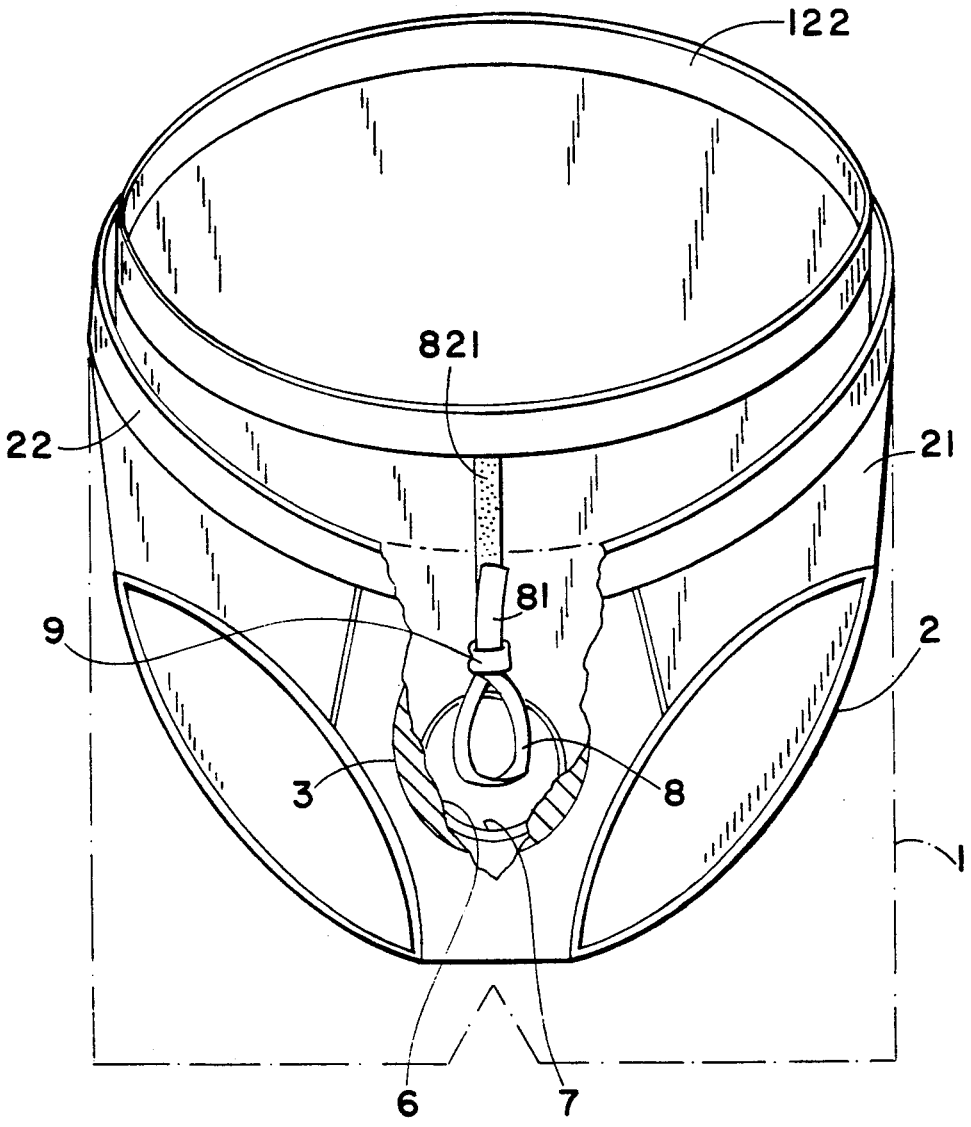
FIG. 1 is a perspective view of the present invention.

The present invention is a removable type underwear device for exposing the genitalia of a male user. FIG. 1 shows a cover (3) attached at one end to a front side (21) of an inner parts having a hole (7) at the front side (21) for exposing the genitalia. An elastic band (22) is attached to the opposite end of cover (3) to avoid its slipping down, and is fixed at both ends of the elastic band (22) at an upper part of the front side (21) of the inner pants (2).

Figure 2:
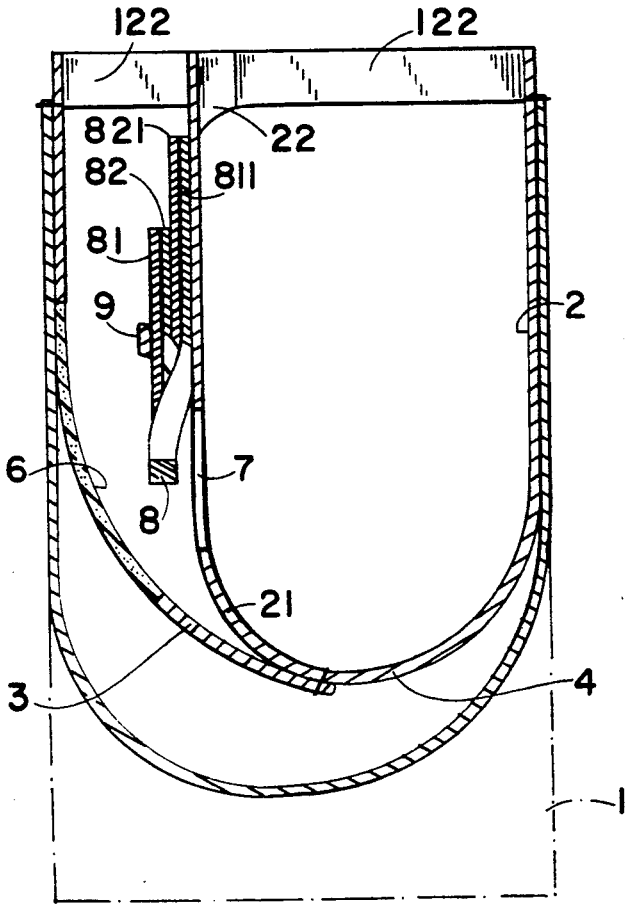
FIG. 2 is a view in vertical cross-section of a second emodiment of the present invention.

As illustrated in FIGS. 1 and 2, the present invention has an adjustable band loop comprising a band loop (8) formed by an upper loop part 81 movable through a fixing knot 9.

The genitalia are inserted through the hole (7) of the frontside (21) of the inner pants (2) and the penis is received in the adjustable loop (8). The cover (3) has a rubbing cloth 6, such as a hemp cloth, for contacting the penis. The adjustable band loop (8) has an adhibiting part 811 above the hole 7.

VELCRO tape, i.e. hook (82) and loop (821) fastener, is provided on the upper part (81) of the band (8) and the band adhibiting part (811), respectively, as a method of adhesion.

FIG. 2 shows that outside of the cover (3) and the inner pants (2) are sewn outer pants (1) for containing the inner pants (2) and the cover (3). When sewn to outer pants (1), a rear part (4) of the inner pants (2) is unnecessary, and the front side (21) of the inner pants (2) is connected by sewing. A waist band (122) is also provided at a top of the outer pants (1) and the inner pants (2). The present invention allows the cover (3) to be pulled down from the inner pants (2) at one end of the cover (3), i.e. at the elastic band 22 which is attached to waist band 122, for exposing the genitalia for such purposes as excretion. Therefore, the present invention provides convenience and also eliminates any trouble encountered when excreting.

Moreover, the present invention allows for easy adjustment of the band loop size in accordance with the individual penis size.

What is claimed are:

1. Briefs for the support of male genitalia, the genitalia including a penis, the briefs comprising:
   - an inner pants having a hole at a front side of the inner pants for the insertion of the genitalia;
   - a front side band having two ends, each end attached to the front of the inner pants;
   - a cover attached to the front side band at one end of the cover and attached to the front side of the inner pants at an opposite end of the cover for exposing or covering the genitalia as desired;
   - loop means attached to the front side of the inner pants and located between the front side of the inner pants and the cover, the loop means for receiving the penis of the genitalia.

2. The briefs according to claim 1, including a rubbing cloth on the cover for contacting the penis.

3. The briefs according to claim 2, wherein the loop means comprises an adjustable loop.

4. The briefs according to claim 3, wherein the loop means further comprises a hook and loop fastner.

5. The briefs according to claim 1, including a waist band attached to a top of the inner pants.

6. Briefs for the support of male genitalia, the genitalia including a penis, the briefs comprising:
   - an outer pants;
   - an inner pants attached to an inner side of the outer pants, the inner pants having a hole at a front side of the inner pants for the insertion of the genitalia;
   - a waist band attached to a top of the outer pants;
   - a front side band of the inner pants having two ends, each end attached to the waist band of the outer pants;
   - a cover attached to an inner front side of the outer pants and to the front side of the inner pants for exposing or covering the genitalia as desired;
   - loop means attached to the front side of the inner pants and located between the front side of the inner pants and the cover, the loop means for receiving the penis of the genitalia.

* * * * *